US011430313B2

(12) United States Patent
Pedersen et al.

(10) Patent No.: US 11,430,313 B2
(45) Date of Patent: Aug. 30, 2022

(54) PRINTED CIRCUIT BOARD FOR SMOKE DETECTOR

(71) Applicant: Autronica Fire & Security AS, Trondheim (NO)

(72) Inventors: Ole Martin Pedersen, Trondheim (NO); Per Johan Vannebo, Trondheim (NO); Hans Jorgen Svendsen, Trondheim (NO)

(73) Assignee: AUTRONICA FIRE & SECURITY AS, Trondheim (NO)

( * ) Notice: Subject to any disclaimer, the term of this patent is extended or adjusted under 35 U.S.C. 154(b) by 0 days.

(21) Appl. No.: 17/056,537

(22) PCT Filed: May 31, 2018

(86) PCT No.: PCT/EP2018/064380

§ 371 (c)(1),
(2) Date: Nov. 18, 2020

(87) PCT Pub. No.: WO2019/228635

PCT Pub. Date: Dec. 5, 2019

(65) Prior Publication Data

US 2021/0209917 A1 Jul. 8, 2021

(51) Int. Cl.
*G08B 17/103* (2006.01)
*G08B 17/06* (2006.01)

(52) U.S. Cl.
CPC ..... *G08B 17/103* (2013.01); *G08B 17/06* (2013.01)

(58) Field of Classification Search
CPC ..... G08B 17/103; G08B 17/06
See application file for complete search history.

(56) References Cited

U.S. PATENT DOCUMENTS 4,623,878 A * 11/1986 Schoenwetter ..... A47G 33/04 340/522
4,728,801 A * 3/1988 O'Connor ..... G08B 17/107 250/573

(Continued)

FOREIGN PATENT DOCUMENTS

CN 101546465 B 3/2011
CN 104408863 A 3/2015

(Continued)

OTHER PUBLICATIONS

ISR/WO for Application No. PCT/EP2018/064380; dated Feb. 20, 2019; 21 pages.

*Primary Examiner* — Hoi C Lau
(74) *Attorney, Agent, or Firm* — Cantor Colburn LLP

(57) ABSTRACT

Disclosed is a smoke detector comprising: a housing including a base, the base including a planar surface configured for being positioned against and attached to a ceiling, a printed circuit board (PCB) comprising a substantially planar shape with a front surface and an opposing back surface spaced in a thickness direction T, and a plurality of perimeter edges including a bottom edge and an opposing top edge spaced in a height-wise direction H, a first side edge and an opposing second side edge spaced in a transverse direction, wherein the top edge comprises a first projection extending in the height-wise direction away from the top edge, the first projection including a first temperature sensor height-wise spaced from the top edge, and the PCB is mounted to the housing so that the front surface of the PCB is perpendicular to the planar surface of the base.

18 Claims, 6 Drawing Sheets

(56) References Cited

U.S. PATENT DOCUMENTS 4,851,819 A * 7/1989 Kawai ..... G08B 17/107 340/630
6,111,511 A * 8/2000 Sivathanu ..... G08B 17/12 250/336.1
6,351,219 B1 2/2002 Tanguay et al.
6,756,905 B2 6/2004 Rattman et al.
7,159,789 B2 1/2007 Schwendinger et al.
7,159,790 B2 1/2007 Schwendinger et al.
7,264,175 B2 9/2007 Schwendinger et al.
7,365,846 B2 * 4/2008 Hess ..... G08B 17/113 356/338
7,616,126 B2 11/2009 Kadwell et al.
8,106,784 B2 * 1/2012 Katou ..... G08B 17/113 340/628
8,816,867 B2 * 8/2014 Mammoto ..... G08B 17/00 340/632
9,046,414 B2 6/2015 Fadell et al.
9,390,605 B2 * 7/2016 Schmid ..... G08B 29/043
9,466,194 B1 * 10/2016 Kraz ..... G08B 21/14
9,704,365 B2 7/2017 Brigham et al.
2002/0089426 A1 * 7/2002 Qualey ..... G08B 17/107 340/628
2002/0154018 A1 * 10/2002 Nishikawa ..... G08B 17/113 340/630
2002/0158767 A1 * 10/2002 Nishikawa ..... G08B 29/183 340/577
2003/0167850 A1 * 9/2003 Ishiguro ..... G01C 9/06 73/718
2004/0130318 A1 * 7/2004 Saltsov ..... H01F 17/0013 324/207.17
2006/0004256 A1 * 1/2006 Gilad ..... A61B 1/041 600/160
2006/0007009 A1 * 1/2006 Hess ..... G08B 17/107 340/628
2006/0017580 A1 * 1/2006 Hess ..... G08B 17/113 340/630
2008/0018485 A1 * 1/2008 Kadwell ..... G08B 17/113 340/630
2008/0266121 A1 * 10/2008 Ellul ..... G08B 7/066 340/584
2009/0051552 A1 * 2/2009 Chabanis ..... G08B 29/26 340/584
2009/0243835 A1 * 10/2009 Katou ..... G08B 17/113 340/521
2010/0078739 A1 * 4/2010 Xue ..... B81B 7/0074 257/415
2013/0044444 A1 * 2/2013 Creighton ..... F21V 23/0442 361/752
2013/0201022 A1 * 8/2013 Brigham ..... G08B 17/107 340/584
2013/0255391 A1 * 10/2013 Schlitzkus ..... G01L 19/148 73/753
2015/0145684 A1 * 5/2015 Schmid ..... G08B 17/10 340/628
2016/0343226 A1 * 11/2016 Fischer ..... G08B 17/107
2017/0038272 A1 * 2/2017 Jacobs ..... G01L 19/148
2017/0162019 A1 6/2017 Cruse et al.
2018/0054553 A1 * 2/2018 Choi ..... H04N 5/247
2019/0180590 A1 * 6/2019 Fischer ..... G08B 17/107
2020/0068277 A1 * 2/2020 Drewett ..... H04Q 9/00
2020/0257868 A1 * 8/2020 Ryabinin ..... G06K 7/10821
2020/0405949 A1 * 12/2020 Yigal ..... A61M 5/46
2021/0092848 A1 * 3/2021 Chaussat ..... G01H 1/00
2021/0192911 A1 * 6/2021 Goes Gasparoto .. G01B 5/0035
2021/0209917 A1 * 7/2021 Pedersen ..... G08B 17/113

FOREIGN PATENT DOCUMENTS

CN 102314743 B 6/2015
EP 0569712 B1 3/1998
EP 1253566 A2 10/2002
EP 1163650 B1 2/2003
EP 1049061 B1 7/2004
EP 1376504 B1 2/2006
EP 2109085 A2 10/2009
EP 2320397 B1 5/2012
EP 2320398 A1 11/2012
EP 2940668 A2 11/2015
EP 2685437 B1 2/2016
EP 2263219 B1 4/2017
GB 2170597 A 8/1986

* cited by examiner

PRINTED CIRCUIT BOARD FOR SMOKE DETECTOR

CROSS REFERENCE TO RELATED APPLICATIONS

This is a US National Stage of Application No. PCT/EP2018/064380, filed on May 31, 2018, the disclosure of which is incorporated herein by reference.

BACKGROUND

Exemplary embodiments pertain to the art of printed circuit boards for smoke detectors and more specifically to a vertically oriented printed circuit board for a smoke detector.

Detecting smoke fires may be performed using a light emitter and a light receiver disposed at an angle relative to each other. The detector may sense light scattered by smoke. An optical smoke detector may consist of a housing that contains a printed circuit board (PCB) and optical components with a detection volume that is isolated from outside light. Optical components may be usually placed in a preform-jig configured for predetermined angles. For heat sensing, a leaded thermistor may be soldered to the PCB. The leads may allow a sensing element to be placed in the airstream. Assembly of traditional detectors may be labor intensive and difficult to automate.

BRIEF DESCRIPTION

Disclosed is a smoke detector comprising: a housing including a base, the base including a planar surface configured for being positioned against and attached to a ceiling, a printed circuit board (PCB) comprising a substantially planar shape with a front surface and an opposing back surface spaced in a thickness direction T, and a plurality of perimeter edges including a bottom edge and an opposing top edge spaced in a height-wise direction H, a first side edge and an opposing second side edge spaced in a transverse direction, wherein the top edge comprises a first projection extending in the height-wise direction away from the top edge, the first projection including a first temperature sensor height-wise spaced from the top edge, and the PCB is mounted to the housing so that the front surface of the PCB is perpendicular to the planar surface of the base, and the first projection extends away from the planar surface of the base.

In addition to one or more of the above disclosed features or as an alternate the top edge of the PCB includes a first segment which is transversely intermediate the first side edge and the second side edge, the first segment having a profile shape that defines a cutout area in the planar shape of the PCB.

In addition to one or more of the above disclosed features or as an alternate a light detector connected to the first segment at a first location, the light detector being oriented so that a center focus of detection extends along a first axis that extends into the cutout area, and a light emitter connected to the first segment at a second location within the cutout area, the light emitter being oriented so that a center focus of projection extends along a second axis that extends into the cutout area.

In addition to one or more of the above disclosed features or as an alternate at least a first electrical lead extends in the height-wise direction away from the bottom edge of the PCB for electrically connecting the PCB to a base of the smoke detector.

In addition to one or more of the above disclosed features or as an alternate at least a second electrical lead extends in the thickness direction away from the front surface of the PCB for electrically connecting the PCB to a peripheral component.

In addition to one or more of the above disclosed features or as an alternate the first top segment of the PCB includes a first transverse end proximate the first side edge of the PCB, the first transverse end comprising a first projection extending in the height-wise direction away from the first top segment, the first projection including a first temperature sensor.

In addition to one or more of the above disclosed features or as an alternate the first top segment of the PCB includes second transverse end that opposes the first transverse end and is proximate the second side edge of the PCB, the second transverse end comprising a second projection extending parallel to the first projection, wherein the smoke detector includes a plurality of temperature sensors including the first temperature sensor and a second temperature sensor, and wherein the second projection including a second temperature sensor.

In addition to one or more of the above disclosed features or as an alternate the housing includes a first side wall, and the base including a first electrical connector, wherein the first electrical lead in the PCB is electrically connected to the first electrical connector in the base, and the first side edge of the PCB is positioned against the first side wall of the housing.

In addition to one or more of the above disclosed features or as an alternate the smoke detector comprises a smoke chamber positioned over the first segment of the top edge of the PCB, wherein the smoke chamber is positioned transversely between the first projection and the second projection, and wherein the smoke chamber includes: a first cavity for receiving smoke, the first cavity extending away from the top edge of the PCB in the height-wise direction, and the first cavity including at least a first opening for fluidly receiving a flow of smoke and directing the flow of smoke to the plurality of temperature sensors.

In addition to one or more of the above disclosed features or as an alternate the first electrical lead comprises a plurality of electrical pins and the second electrical lead comprises a plurality of electrical mounting hooks.

Further disclosed is a method of manufacturing a smoke detector including one or more of the above disclosed features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
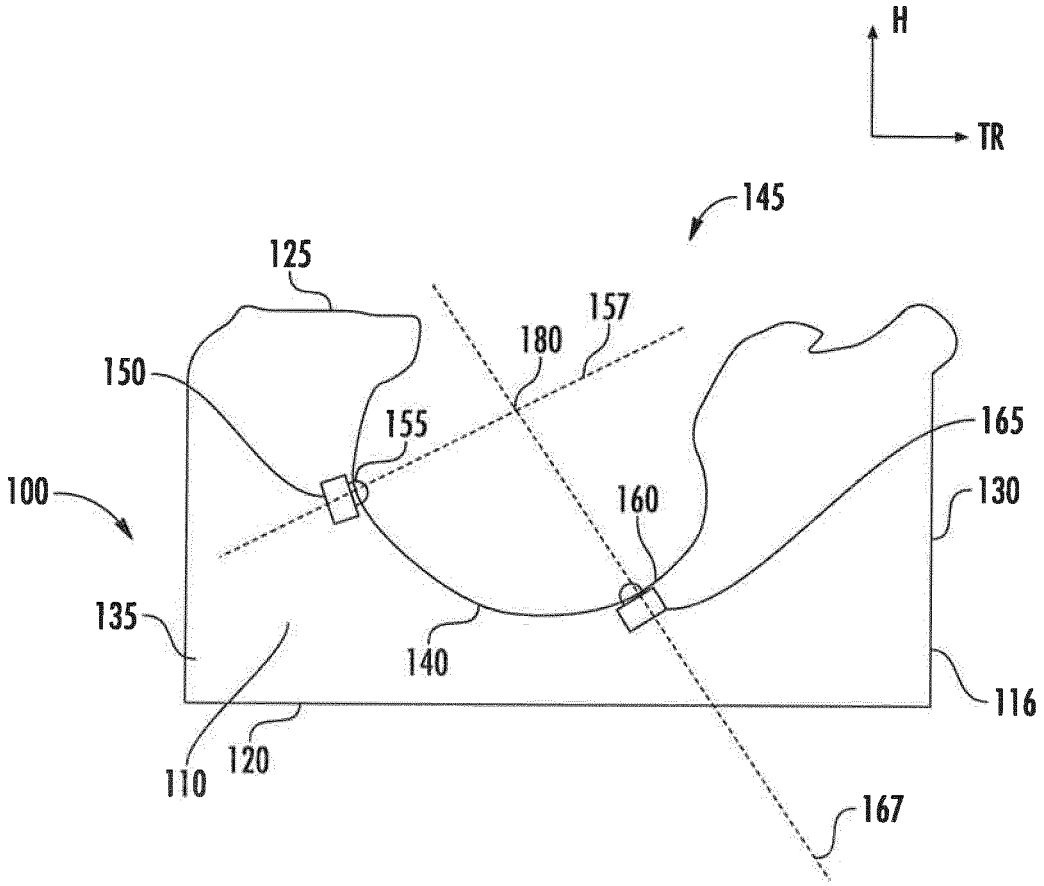
FIG. 1 is a schematic illustration of a printed circuit board (PCB) according to a disclosed embodiment.

Turning to FIG. 1, schematically disclosed is a printed circuit board (PCB) 100 for a smoke detector 105. The PCB 100 (illustrated in schematically in FIG. 2) may comprise a substantially planar shape with a front surface 110 and an opposing back surface 115 spaced in a thickness direction T (see FIG. 4) defining a plane 116 of the PCB. A plurality of perimeter edges on the PCB 100 may include a bottom edge 120 and an opposing top edge 125 spaced in a height-wise direction H. In addition a first side edge 130 and an opposing second side edge 135 may be spaced in a transverse direction TR.

The top edge 125 may include a first segment 140 which may be transversely intermediate the first side edge 130 and the second side edge 135. The first segment 140 may have a profile shape that may define a cutout area 145 in the planar shape of the PCB 100.

A light detector 150 may be connected to the first segment 140 at a first location 155. The light detector 150 may be oriented so that a center focus of projection extends along a first axis 157 that extends into the cutout area 145. A light emitter 165 may be connected to the first segment 140 at a second location 160 within the cutout area 135. The light emitter 165 may be oriented so that a center focus of detection extends along a second axis 167 that extends into the cutout area 145.

The first axis of 157 for the light detector 150 and the second axis 167 for the light emitter 165 may be parallel to the plane 116 of the PCB 100. In addition, the first axis of 157 for the light detector 150 and the second axis 167 for the light emitter 165 may intersect at a point 180 disposed within the cutout area 145.

Figure 2:
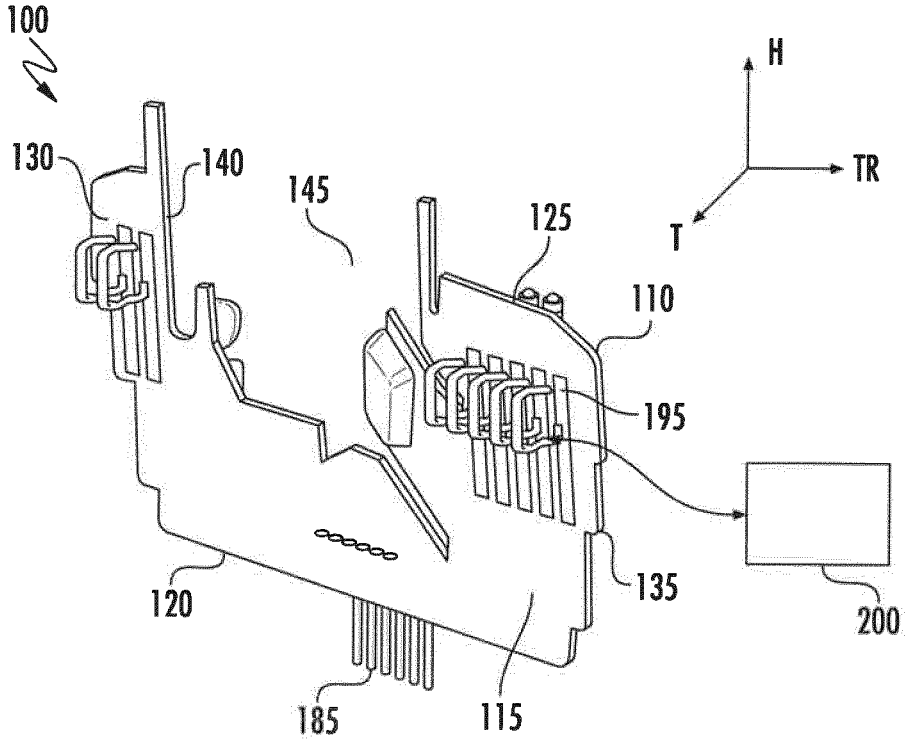
FIG. 2 illustrates a PCB according to a disclosed embodiment.
Figure 3:
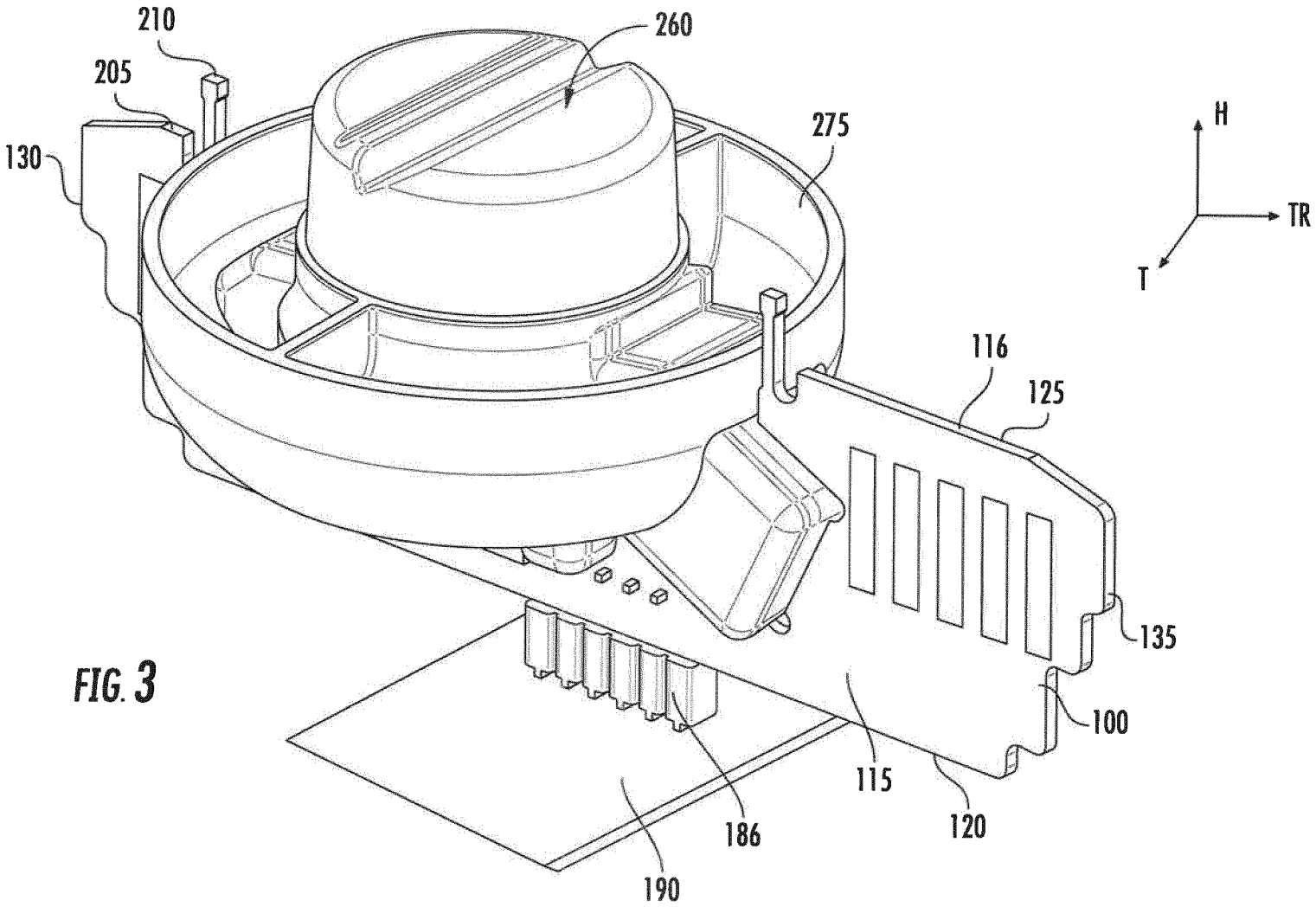
FIG. 3 illustrates a PCB installed in a base of a detector housing according to a disclosed embodiment.

As illustrated in FIG. 2, at least a first electrical lead 185 may extend in the height-wise direction away from the bottom edge 120 within the plane 116 of the PCB 100. In the illustration the first electrical lead 185 is a first plurality of electrical leads and yet more specifically are a plurality of electrical pins. The first plurality of electrical pins may electrically connect the PCB 100 to a port 186 in a base 190 (FIG. 3) of the smoke detector 105 and may receive transmitted network communications and power. The port 186 may be, for example, a serial port.

As further illustrated in FIG. 2, at least a second electrical lead 195 may extend in the thickness direction away from the back surface 115 of the PCB 100. In the illustration, the second electrical lead 195 may be a second plurality of electrical leads and more specifically a plurality of mounting hooks that function similarly to the first plurality of electric leads. That is, the second plurality of electric leads provide power and network to a peripheral 200 that may be supported in the mounting hook formation of the leads. The attached peripheral, illustrated schematically, be further PCB containing a further microcontroller. For example the attached peripheral 200 may be a carbon monoxide (CO), sensor, sounder, beacon, etc., containing features not already in the PCB 100.

Figure 4:
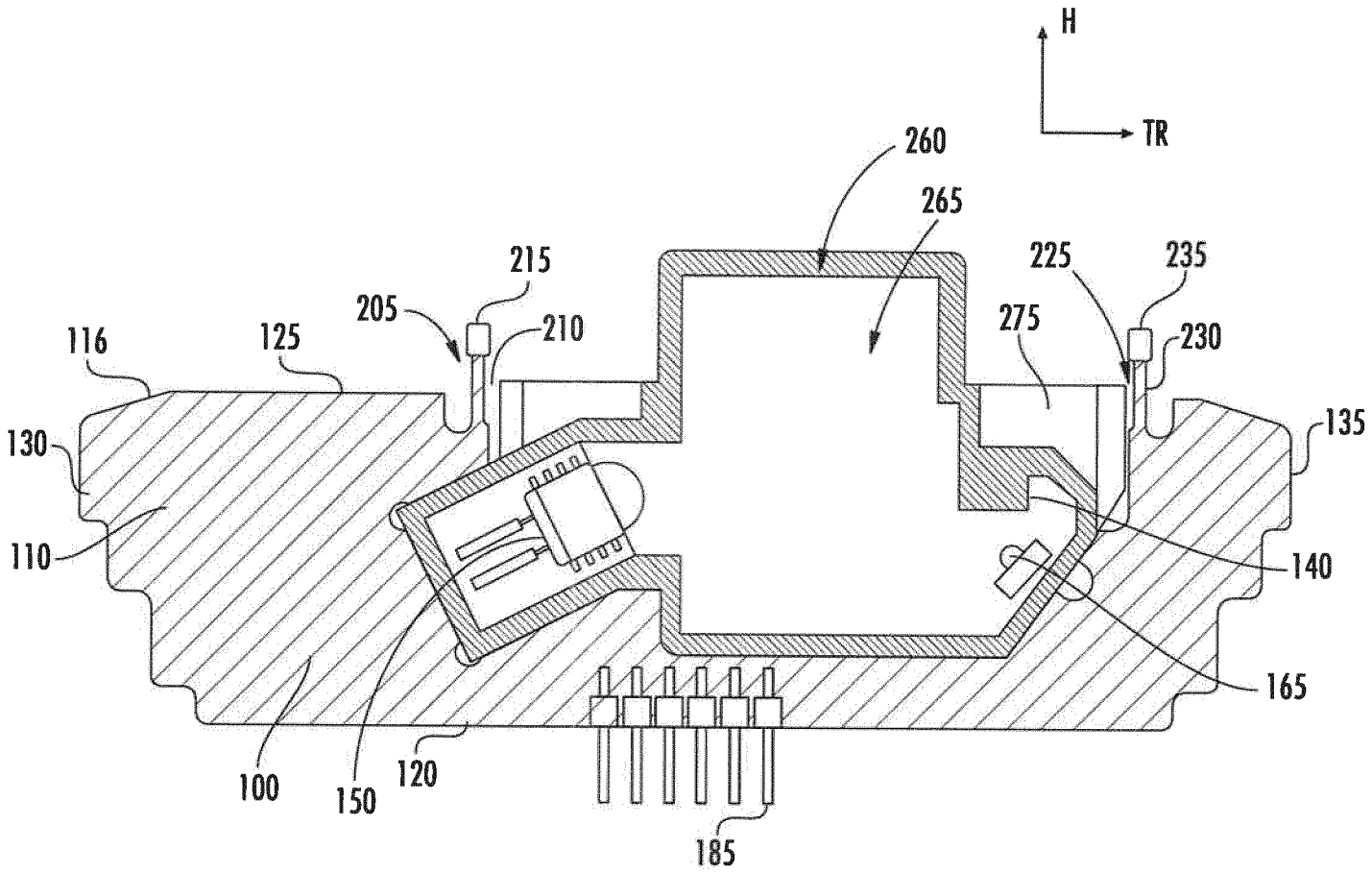
FIG. 4 illustrates a front view of a PCB with a smoke chamber according to a disclosed embodiment.

As illustrated in FIG. 4, the first top segment 140 of the PCB 100 may include a first transverse end 205 proximate the first side edge 130 of the PCB 100. The first transverse end 205 may include a first projection or stub 210 extending in the height-wise direction in the plane 116 of the PCB 100 away from the top edge 125. The first projection 210 may include a first temperature sensor 215 (illustrated schematically).

In addition, the first top segment 140 of the PCB 100 may include second transverse end 225 that opposes the first transverse end 205 and may be proximate the second side edge 135 of the PCB 100. The second transverse end 225 may include a second projection 230 extending parallel to the first projection 210. The second projection may include a second temperature sensor 235 (illustrated schematically). Both temperature sensors may be thermistor sensors.

Figure 5:
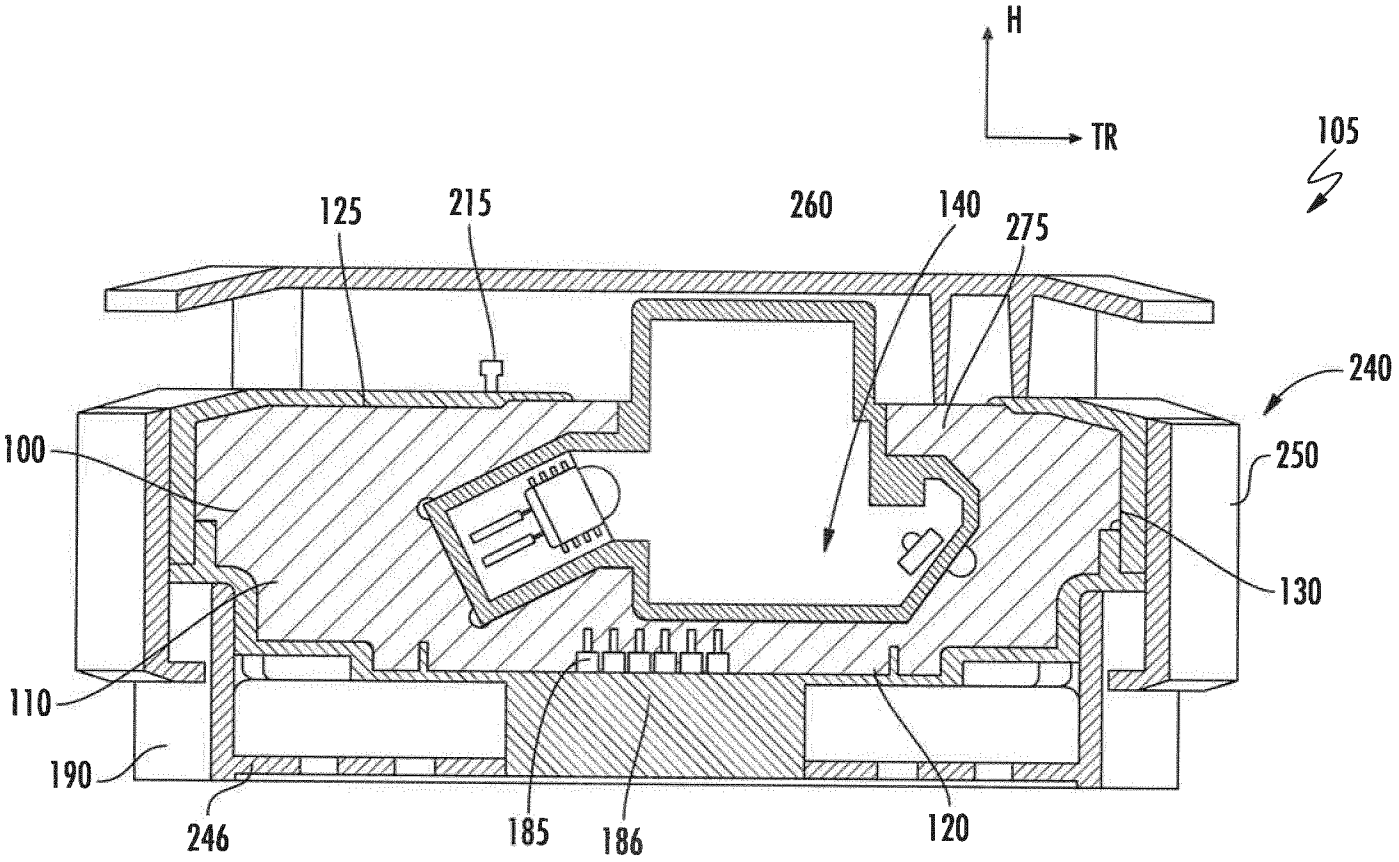
FIG. 5 illustrates a PCB installed in a detector housing according to a disclosed embodiment.

Turing to FIG. 5, with further attention to the smoke detector 105, there may be a housing 240 including the base 190 and a first side wall 250. The base 190 may include a planar surface 246 that may be connected to a ceiling. The base 190 may further include port 186 identified above. The PCB 100 may be fixedly connected to the base 190 so that the bottom edge 120 of the PCB 100 may be disposed against the base 190 and the PCB 100 may extend perpendicularly away from the planar surface 246 of the base 190. In this configuration the first side edge 130 of the PCB 100 may be positioned against the first side wall 250 of the housing 240.

Figure 6:
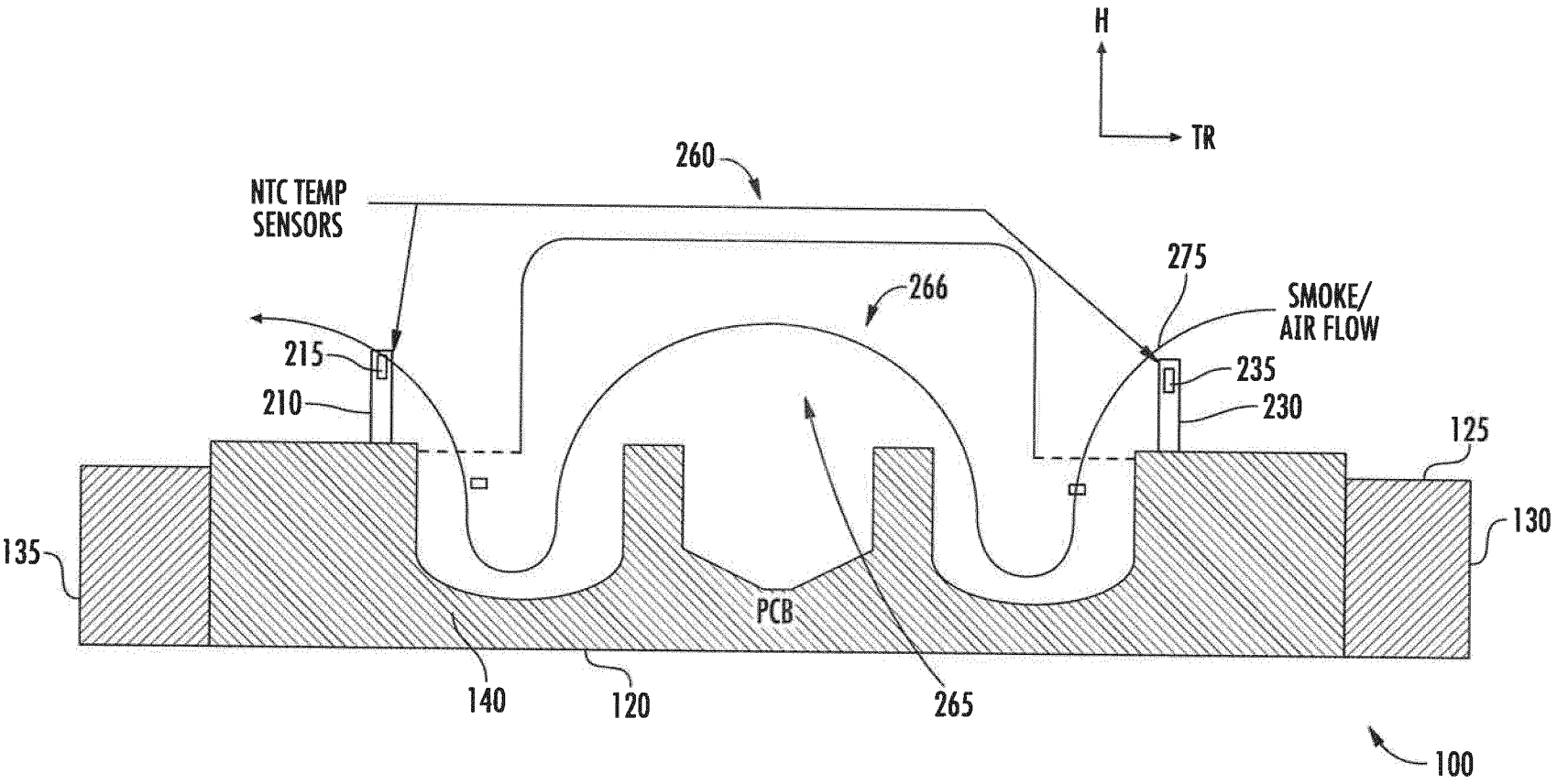
FIG. 6 is a schematic illustration of a PCB installed in a detector housing according to a disclosed embodiment.

Turning to FIG. 6 the smoke detector 105 may include a smoke chamber 260 which may be positioned over the first segment 140 of the top edge 125 of the PCB 100. The smoke chamber 260 may be positioned transversely between the first projection 210 and the second projection 230, that is, between the temperature sensors 215, 235.

The smoke chamber 260 may include a first cavity 265 for receiving a flow of smoke 266. The first cavity 265 may extend away from the top edge 125 of the PCB 100 in the height-wise direction. The first cavity 265 may include at least a first opening 275 for fluidly receiving smoke. The opening directs air and a flow of smoke 266 to the temperature sensors 215, 235 when entering and exiting the chamber 260.

The above disclosed fire detector design may provide (1) a vertically mounted printed circuit board PCB, perpendicular to a detector mounting plane, (2) a smoke detection structural cut-out (void or volume) within the vertically mounted PCB that intersects inside an area of the PCB, wherein such configuration may provide for increased design versatility, (3) one or more PCB protrusions (stubs) on the vertically mounted PCB which may be suitable for automated mounting of one or more temperature sensors, which may be negative temperature coefficient thermistors (NTCs), (4) one or more side sensing (into the cut-out) surface mounted light emitters and receivers, which may be suitable for automated mounting on the vertically mounted PCB.

The features disclosed herein may be well suited for the inclusion of one or more scattering angles. The disclosed embodiments apply three light sources and one light receiver. The disclosed embodiments also use a PCB that is mounted perpendicular to a mounting plane, though the disclosed features may be applicable to mounting PCBs at many angles relative to the mounting plane. An open area inside the PCB may provide a smoke detection area in which side looking photoelectric detectors (PDs) and light emitting diodes (LEDs) are mounted with multiple angles between them also while the optical axes are parallel to the plane 116 of the PCB 100.

The above disclosed features may provide a way of mounting NTCs in a fire detector. The disclosed embodiments provide surface mounted NTCs to printed circuit board (PCB) stubs. The PCB stubs protrude where there may be air flow, which may provide sensing relatively accurate temperature fluctuations. Due to a low thermal mass of the PCB stub, a temperature response may be increased. Vertical mounting of the PCB may enable relatively optimal access of the airstream.

The above invention combined with detection volume within the PCB may allow for a compact design that is efficiently manufactured. Surface mounted NTCs on PCB stubs may be mounted using automated process during PCB manufacturing. This may reduce or eliminate a need for manual mounting or complex automatic mounting of temperature sensors in a fire detector. Placing a PCB vertically related to a mounting plane may leave more usable space available in a detector, and may allow for protrusion of NTC stubs into the air stream.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A smoke detector comprising:

a housing including a base, the base including a planar surface configured for being positioned against and attached to a ceiling, a printed circuit board (PCB) comprising a substantially planar shape with a front surface and an opposing back surface spaced in a thickness direction T, and a plurality of perimeter edges including a bottom edge and an opposing top edge spaced in a height-wise direction H, a first side edge and an opposing second side edge spaced in a transverse direction, wherein the top edge comprises a first projection extending in the height-wise direction away from the top edge, the first projection including a first temperature sensor height-wise spaced from the top edge, and the PCB is mounted to the housing, so that the front surface of the PCB is perpendicular to the planar surface of the base, and the first projection extends away from the planar surface of the base, wherein the top edge of the PCB includes a first segment which is transversely intermediate the first side edge and the second side edge, and the first segment having a profile shape that defines a cutout area in the planar shape of the PCB.

2. The smoke detector of claim 1, comprising a light detector connected to the first segment at a first location, the light detector being oriented so that a center focus of detection extends along a first axis that extends into the cutout area, and a light emitter connected to the first segment at a second location within the cutout area, the light emitter being oriented so that a center focus of projection extends along a second axis that extends into the cutout area.

3. The smoke detector of claim 2, wherein at least a first electrical lead extends in the height-wise direction away from the bottom edge of the PCB for electrically connecting the PCB to a base of the smoke detector.

4. The smoke detector of claim 3, wherein at least a second electrical lead extends in the thickness direction away from the front surface of the PCB for electrically connecting the PCB to a peripheral component.

5. The smoke detector of claim 4, wherein the first top segment of the PCB includes a first transverse end proximate the first side edge of the PCB, the first transverse end comprising the first projection extending in the height-wise direction away from the first top segment.

6. The smoke detector of claim 5, wherein the first top segment of the PCB includes second transverse end that opposes the first transverse end and is proximate the second side edge of the PCB, the second transverse end comprising a second projection extending parallel to the first projection, wherein the smoke detector includes a plurality of temperature sensors including the first temperature sensor and a second temperature sensor, and wherein the second projection includes the second temperature sensor.

7. The smoke detector of claim 6, wherein the housing includes a first side wall, and the base includes a first electrical connector, and wherein the first electrical lead in the PCB is electrically connected to the first electrical connector in the base, and the first side edge of the PCB is positioned against the first side wall of the housing.

8. The smoke detector of claim 7, comprising a smoke chamber positioned over the first segment of the top edge of the PCB, wherein the smoke chamber is positioned transversely between the first projection and the second projection, and wherein the smoke chamber includes:

a first cavity for receiving smoke, the first cavity extending away from the top edge of the PCB in the height-wise direction, and the first cavity including at least a first opening for fluidly receiving a flow of smoke and directing the flow of smoke to the plurality of temperature sensors.

9. The smoke detector of claim 8, wherein:

the first electrical lead comprises a plurality of electrical pins and the second electrical lead comprises a plurality of electrical mounting hooks.

10. A method of manufacturing a smoke detector, comprising obtaining a housing that includes a base, the base including a planar surface configured for being positioned against and attached to a ceiling, forming a printed circuit board (PCB) with a substantially planar shape having a front surface and an opposing back surface spaced in a thickness direction T, wherein the PCB includes a plurality of perimeter edges including a bottom edge and an opposing top edge spaced in a height-wise direction H, a first side edge and an opposing second side edge spaced in a transverse direction, wherein the top edge comprises a first projection extending in the height-wise direction away from the top edge, the first projection including a first temperature sensor height-wise spaced from the top edge, and the PCB is mounted to the housing so that the front surface of the PCB is perpendicular to the planar surface of the base, and the first projection extends away from the planar surface of the base, and forming in the top edge of the PCB a first segment which is transversely intermediate the first side edge and the second side edge, and wherein the first segment having a profile shape that defines a cutout area in the planar shape of the PCB.

11. The method of claim 10, comprising connecting a light detector to the first segment at a first location, the light detector being oriented so that a center focus of detection extends along a first axis that extends into the cutout area, and connecting a light emitter to the first segment at a second location within the cutout area, the light emitter being oriented so that a center focus of projection extends along a second axis that extends into the cutout area.

12. The method of claim 11, wherein at least a first electrical lead extends in the height-wise direction away from the bottom edge of the PCB for electrically connecting the PCB to a base of the smoke detector.

13. The method of claim 12, wherein at least a second electrical lead extends in the thickness direction away from the front surface of the PCB for electrically connecting the PCB to a peripheral component.

14. The method of claim 13, wherein the first top segment of the PCB includes a first transverse end proximate the first side edge of the PCB, the first transverse end comprising the first projection extending in the height-wise direction away from the first top segment.

15. The method of claim 14, wherein the first top segment of the PCB includes second transverse end that opposes the first transverse end and is proximate the second side edge of the PCB, the second transverse end comprising a second projection extending parallel to the first projection, wherein the smoke detector includes a plurality of temperature sensors including the first temperature sensor and a second temperature sensor, and wherein the second projection includes the second temperature sensor.

16. The method of claim 15, wherein the housing that includes a first side wall and the base includes a first electrical connector, fixedly connecting the PCB to the base so that the bottom edge of the PCB is disposed against the base, wherein the first electrical lead in the PCB is electrically connected to the first electrical connector in the base, and the first side edge of the PCB is positioned against the first side wall of the housing.

17. The method of claim 16, comprising positioning a smoke chamber over the first segment of the top edge of the PCB, wherein the smoke chamber is positioned transversely between the first projection and the second projection, and wherein the smoke chamber includes a first cavity for receiving smoke, the first cavity extending in the height-wise direction away from the top edge of the PCB, and the first cavity including at least a first opening for fluidly receiving a flow of smoke and directing the flow of smoke to the plurality of temperature sensors.

18. The method of claim 17, wherein:

the first electrical lead comprises a plurality of electrical pins and the second electrical lead comprises a plurality of electrical mounting hooks.

* * * * *